US005080432A

United States Patent [19]

Connell

[11] Patent Number: 5,080,432

[45] Date of Patent: Jan. 14, 1992

[54] CANOPY ATTACHMENT FOR A LAWN CHAIR

[76] Inventor: Brian J. Connell, 204 Short St., Nichols, Iowa 52766

[21] Appl. No.: 677,549

[22] Filed: Mar. 29, 1991

[51] Int. Cl.[5] ..... A47C 7/10

[52] U.S. Cl. ..... 297/184; 297/397; 297/17

[58] Field of Search ..... 297/184, 397; 135/106, 135/109, 112, 117, 96

[56] References Cited

U.S. PATENT DOCUMENTS

| | | | |
|---|---|---|---|
| 2,561,886 | 7/1951 | Rikelman | 297/184 X |
| 2,837,140 | 6/1958 | Hedman | 297/184 X |
| 3,243,230 | 3/1966 | Otto | 297/184 |
| 3,404,915 | 10/1968 | de Sousa Filho | 297/17 |
| 4,030,781 | 6/1977 | Howard | 297/397 |
| 4,687,249 | 8/1987 | Mills | 297/184 |
| 4,865,381 | 9/1989 | Van Rogue | 135/96 X |
| 4,924,896 | 5/1990 | Carter | 297/184 X |

FOREIGN PATENT DOCUMENTS

| | | | |
|---|---|---|---|
| 93591 | 6/1962 | Denmark | 297/184 |

*Primary Examiner*—Laurie K. Cranmer
*Attorney, Agent, or Firm*—Henderson & Sturm

[57] ABSTRACT

A canopy attachment is provided for a lawn chair, notably of the folding type, and has a frame mountable on the chair via detachable connection to the cross rod that appears in the chair at the junction of the chair seat and seat back. The canopy frame is made up of a plurality of relatively foldable parts for compact dispostion when detached from the chair. In addition to the detachable connection to the cross member of the chair, the canopy support frame has a further connection to the chair in upwardly spaced relation to the cross member, plus a roof projecting forwardly from the upper end of the support.

5 Claims, 3 Drawing Sheets

CANOPY ATTACHMENT FOR A LAWN CHAIR

BACKGROUND AND SUMMARY OF THE INVENTION

Many types of umbrellas and shades of various kinds have been known for use with typical lawn chairs. These are primarily cumbersome, difficult to attach to and detach from the chair and lacking in simple, convenient foldability for transport and storage. According to the present invention, these and other shortcomings are eliminated by a novel construction including a canopy support frame easily and simply attachable to and detachable from a typical lawn chair and having a roof that is readily adjustable as to angle relative to the support frame. The novel canopy design features foldability of the several parts or elements for easy transport and storage. Further, the attachment and detachment means are adaptable to lawn chairs of somewhat different designs. Part of the detachable means may be used to tie the folded frame together. Still further, the support frame is so configured as to increase the stability of the frame in use. Further features and advantages will appear as a preferred embodiment of the invention as illustrated and described in the following specification and accompanying drawings.

DETAILED DESCRIPTION OF A PREFERRED EMBODIMENT OF THE INVENTION

Embodiment of the Invention

Figure 1:
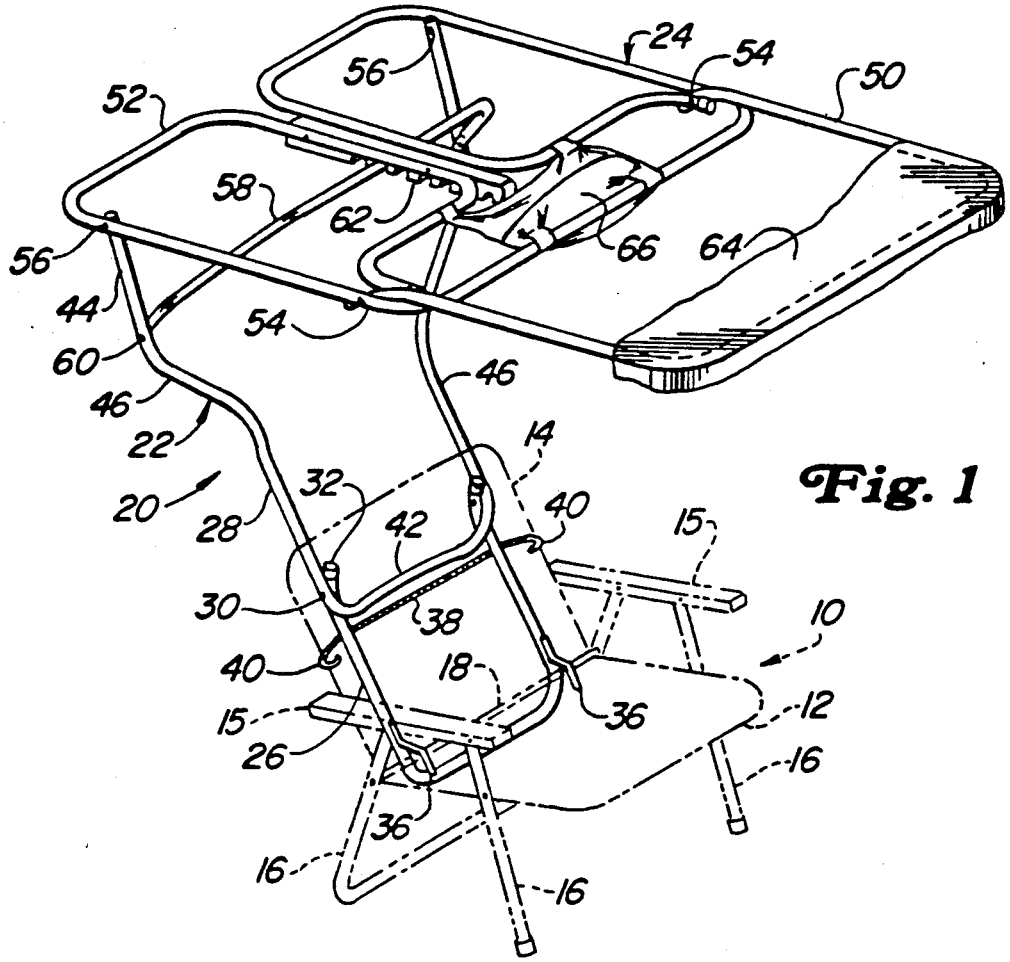
FIG. 1 is a perspective of the assembled canopy structure as attached to a typical lawn chair, the latter being shown in broken lines.

Reference will be had first to FIG. 1 for an overall description of what is involved. Shown in broken lines in that figure is a typical lawn chair 10 of the folding type having a tubular frame including a seat 12, a seat back 14, arms 15 and legs 16. Chairs of this type conventionally have webbing making up the seat and back and this webbing is trained about a cross member 18 at the junction of the seat and back.

The canopy attachment is designated in its entirety by the numeral 20 and comprises essentially a generally upright support frame 22, adjustable roof 24 and mounting means to be described subsequently. The frame 22 is made up of a lower part or element 26 and an upper element or part 28 interconnected by pivot means 30 on a transverse horizontal axis for relative folding, the expressions "horizontal" and "transverse" being used with reference to the orientation of the frame with respect to its position when attached to the chair.

Figure 5:
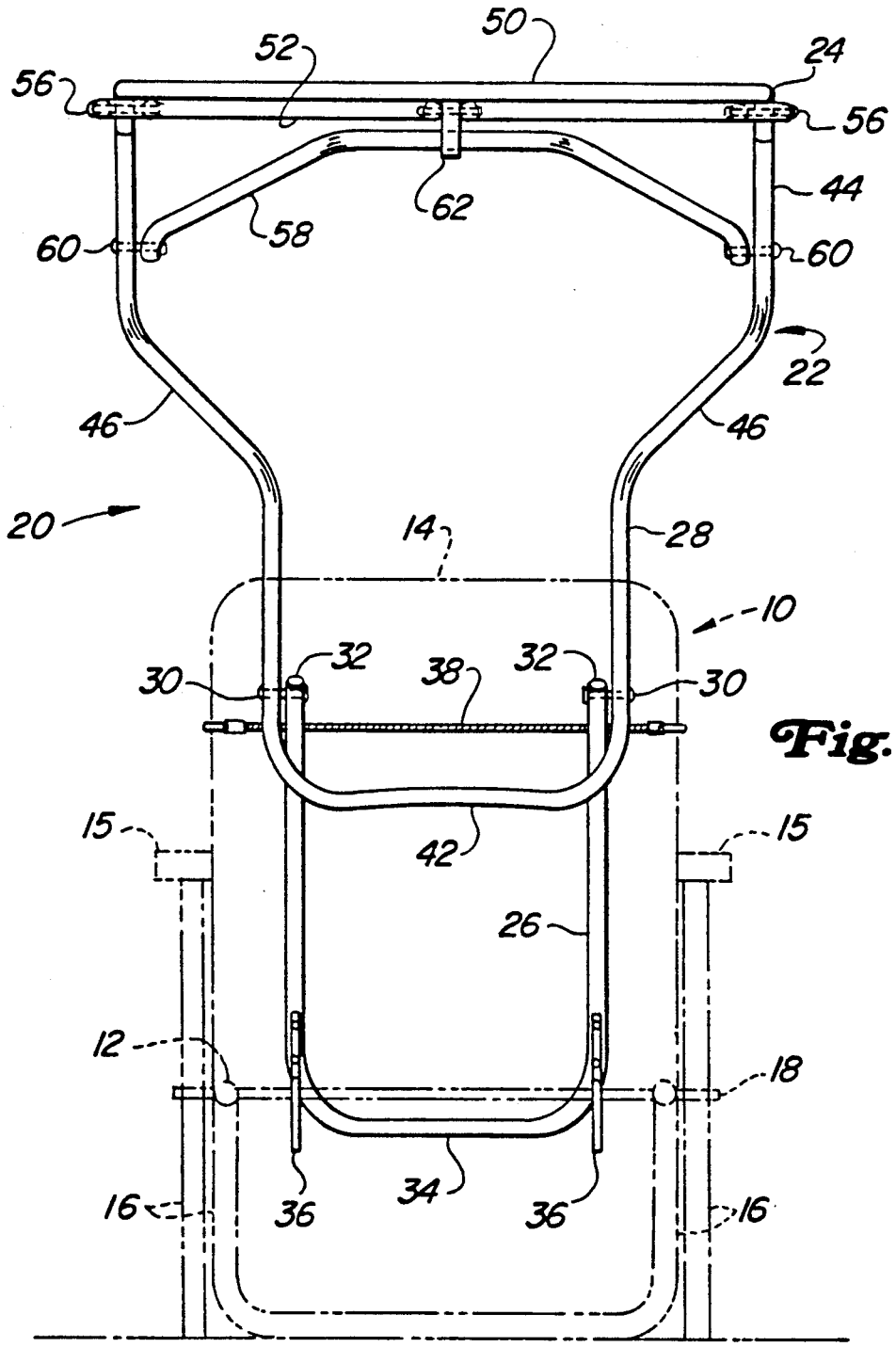
FIG. 5 is a front view, on a scale enlarged over that of FIGS. 1–4, showing the canopy frame in attached position.
Figure 6:
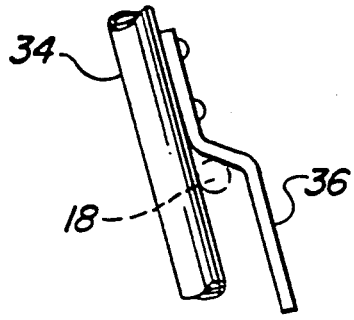
FIG. 6 is an enlarged fragmentary view showing one of the lower frame-to-chair attachment means.

As best seen in FIG. 5, the lower support frame part 26 is in the form of a U having upper and lower end parts 32 and 34 respectively. In its chair mounted position, this frame part lies flatwise against the rear of the seat this frame part lies flatwise against thee rear of the seat back (FIGS. 1 and 2), with the frame lower portion 26 at about the level of the chair cross rod 18 and with the upper portions 32 of the frame part just below the top of the chair seat back. Looking now at FIGS. 1, 2, 5 and 6, it is seen that the frame element 26 carries or has first or lower means for detachable connection to the chair. Specifically, this means comprises a pair of downwardly opening hook elements or means 36 that hook over the chair cross rod or member 18 from above. An upper or second means is used to connect an upper portion of the frame part 28 to the seat back at a level above the hook means 36. This second means is here shown as an elastic cord 38 having hooks 40 at its opposite ends. The hooks are adapted to connect respectively to opposite upright portions of the chair back with the cord stretched and passing behind the upper part of the frame part 26. This is found to provide ample support for the canopy on the chair.

Figure 2:
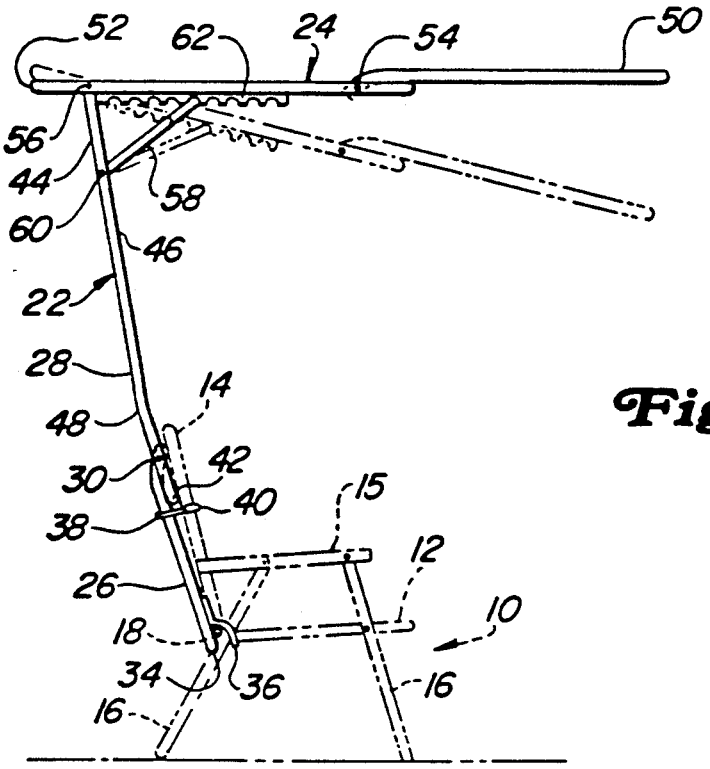
Fig. 2 is a side elevation of the same, with an adjusted position of the canopy roof shown in dotted lines.

The attachment of the lower frame part 26 to the chair back includes support for the upper part 28 of the support frame because of the relationship between the upper part 32 of the frame element 26 and the lower portion of the upper frame element 28, which is best seen in FIGS. 1, 2 and 5. The lower frame element at its top is curved somewhat forwardly so that the lower portion of the upper element is sandwiched between the lower element and the seat back, the lower part of the upper element having a cross member 42 just below the pivot means between the upper and lower frame elements; that is to say, the upper frame element is prevented from moving both forwardly and rearwardly relative to the seat back and thus extends generally upright to an upper end 44 at a level well above that of the chair seat and thus conveniently accommodates a person seated on the chair. The cross member 42 is arched transversely to conform to the curve of the seat back when occupied.

The upper frame or support part is configured so that its lower portion where connected at 30 to the lower support frame element is about as wide as the chair back but has side members 46 more widely spaced apart so as to increase the available dimension for attachment of the roof 24. In addition, the side members 46 are sloped or offset forwardly so as to improve the stability of the attached canopy structure by advancing the center of gravity. The offset will be seen at 48. The support frame, the roof and related parts may be formed of light weight tubular steel or aluminum, for example, to provide a long lasting, portable structure. The support frame may be regarded as a closed loop of the configuration best seen in FIG. 5.

The roof 24 is made up of front and rear parts 50 and 52, respectively, pivoted together on a transverse horizontal axis by pivot means 54, and the rear of the rear roof part is pivoted on a transverse horizontal axis to the upper ends of the upper support frame part by pivots 56. Because of these pivots, the roof as a whole is vertically adjustable relative to the support frame 22 and may be held in any one of several positions by a brace 58 in the form of a bail having its legs pivoted at 60 to the upper end portions 44 of the upper support frame element 28, with the cross part or bight of the brace selectively engageable and disengageable with and from a roof-carried member 62 that has a plurality of downwardly opening notches cooperative with the brace cross part.

The roof is completed by a fabric having weatherproof qualities, which may be of fabric of other material. The fabric is stretched from end to end and cross wise of the roof frame structure and may be removable for many purposes. Also included in the roof area is a pouch means or hammock which is a convenient temporary storage place for glasses, reading material, etc. As a pouch, it provides for storage of the folded roof fabric.

Figure 3:
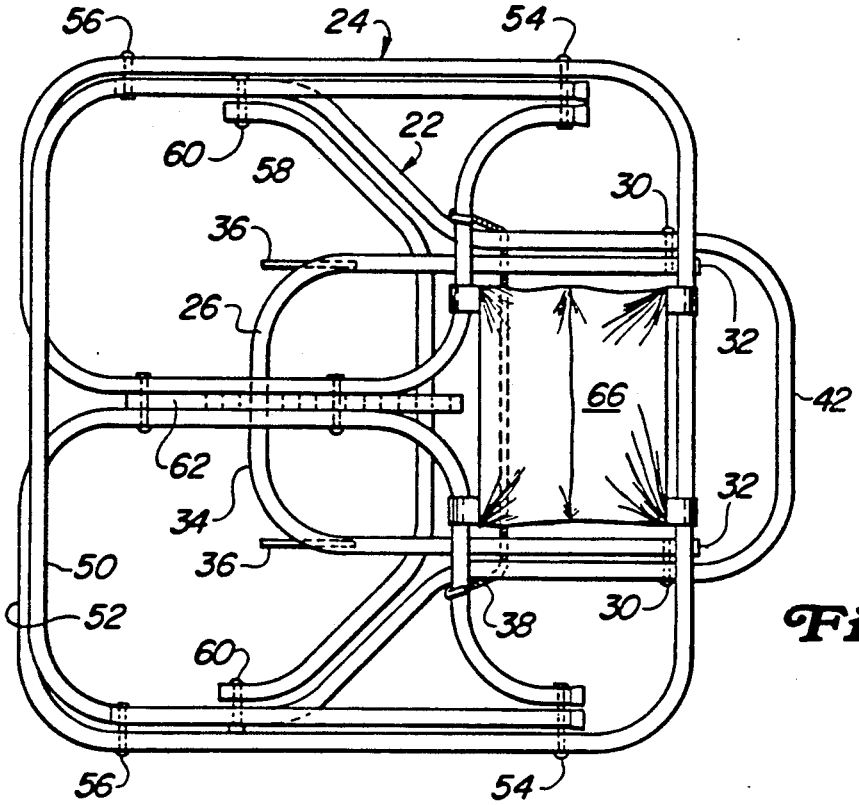
FIG. 3 is showing the canopy folded for storage or transportation, with the roof fabric omitted.
Figure 4:
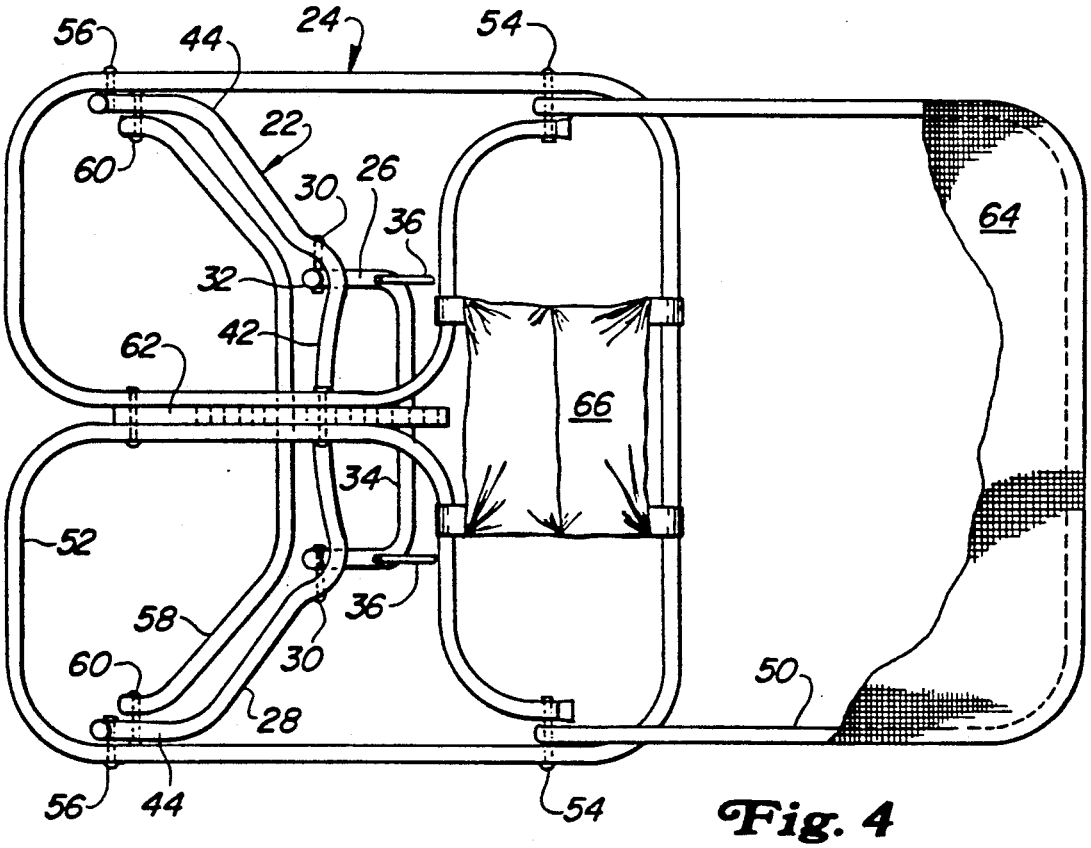
FIG. 4 is a similar plan with the structure unfolded or extended for use, a portion of the roof fabric being shown in this view.

With respect to the foldability feature of the canopy support and roof, it has already been noted that the upper and lower support frame parts are pivoted for folding at the axis through the pivots 30. In extended position when the structure is attached to the chair, the front roof part extends cantilever fashion from the front of the rear roof part, because the pivots 54 between the roof parts are rearwardly of the front cross member of the rear roof part and the front roof part overhangs and is supported by this cross member. This arrangement enables the front part of the roof to be folded upwardly and rearwardly atop the rear roof part, the fabric having been preferably first removed. When the elastic cord 38 is unhooked and removed, the support frame may be easily lifted from its hooked connection with the chair cross rod and the support frame elements are folded upon each other along with the roof parts and disconnected brace 58 and the whole interconnected as a compact "package" by using the elastic cord as shown in FIG. 3.

Features and advantage of the invention, in addition to those pointed out, will readily occur to those versed in the art, as will alternations in and additions to the preferred embodiment disclosed, all without departure from the spirit and scope of the invention.

I claim:

1. A canopy attachment for a lawn chair of the type having a seat, a seat back and a horizontal cross member at the junction of the seat and seat back, comprising: a support frame having a lower portion adapted for disposition flat-wise against and behind the seat back and an upper portion projecting above the seat back to a level accommodating a person sitting on the seat, first means on the frame lower portion for detachable connection of the frame to the chair cross member, second means detachably connecting the frame to the seat back above the cross member, a fore-and-aft elongated roof having front and rear parts, and means at the rear end of the roof for connection to and at the level of the upper portion of the frame to extend generally horizontally over the seat, said means connecting the rear part of the roof to the upper portion of the frame including a pivot on a transverse axis to enable vertical swinging of the roof relative to the support frame, and disconnectible brace means provided between the roof and support frame for supporting the roof against such swinging.

2. A canopy attachment according to claim 1, in which the brace means is selectively positionable to enable variations of the angle between the roof and the support frame.

3. A canopy attachment according to claim 2, in which the brace means includes a position enabling forward and downward folding of the roof flat-wise against the support frame when the canopy attachment is removed from the chair.

4. A canopy attachment for a lawn chair of the type having a seat, a seat back and a horizontal cross member at the junction of the seat and seat back, comprising: a support frame having a lower portion adapted for disposition flat-wise against and behind the seat back and an upper portion projecting above the seat back to a level accommodating a person sitting on the seat, first means on the frame lower portion for detachable connection of the frame to the chair cross member, second means detachably connecting the frame too the seat back above the cross member, a force-and-aft elongated roof having front and rear parts, and means at the rear end of the roof for connection to and at the level of the upper portion of the frame to extend generally horizontally over the seat said means connecting the rear part of the roof to the upper portion of the frame including a pivot on a transverse axis to enable vertical swinging of the roof relative to the support frame, and disconnectible brace means is provided between the roof and support frame for supporting the roof against such swinging, said brace means including ann inverted U-shaped member having legs pivoted to the upper portion of the support frame on a horizontal axis below the pivot axis of the roof to the support frame, and a transverse bight interconnecting the legs and engageable with the roof at a point ahead of the pivot axis of the roof to the support frame.

5. A canopy attachment according to claim 4, in which the roof includes a member having a plurality of fore-and-aft spaced apart notches opening downwardly for selective engagement with the bight of the brace for selectively varying the angle of the roof relative to the support frame.

* * * * *

UNITED STATES PATENT AND TRADEMARK OFFICE

CERTIFICATE OF CORRECTION

PATENT NO. : 5,080,432

DATED : January 14, 1992

INVENTOR(S) : Brian J. Connell

It is certified that error appears in the above-identified patent and that said Letters Patent is hereby corrected as shown below:

At Column 1, line 47 delete "Embodiment of the Invention".

At Column 2, lines 1 and 2 please delete "this frame part lies flatwise against the rear of the seat". At Column 4, line 24 "too" should read --to--. At Column 4, line 25 "force-and-aft" should read --fore-and-aft--. At Column 4, line 35 "ann" should read --an--.

Signed and Sealed this

Thirteenth Day of July, 1993

Attest:

Michael K. Kirk

MICHAEL K. KIRK

Attesting Officer

Acting Commissioner of Patents and Trademarks